US009837202B2

(12) United States Patent
Kainaga et al.

(10) Patent No.: US 9,837,202 B2
(45) Date of Patent: Dec. 5, 2017

(54) STATIONARY INDUCTION APPARATUS

(71) Applicant: Mitsubishi Electric Corporation, Chiyoda-ku (JP)

(72) Inventors: Soichiro Kainaga, Chiyoda-ku (JP); Takahiro Umemoto, Chiyoda-ku (JP); Takao Tsurimoto, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/355,309

(22) Filed: Nov. 18, 2016

(65) Prior Publication Data

US 2017/0169938 A1 Jun. 15, 2017

(30) Foreign Application Priority Data

Dec. 9, 2015 (JP) ..... 2015-240078
Aug. 9, 2016 (JP) ..... 2016-156370

(51) Int. Cl.

| | |
|---|---|
| ***H01F 27/32*** | (2006.01) |
| ***H01F 27/36*** | (2006.01) |
| ***H01F 27/24*** | (2006.01) |
| ***H01F 27/28*** | (2006.01) |
| ***H01F 27/02*** | (2006.01) |
| ***H01F 27/34*** | (2006.01) |

(52) U.S. Cl.

CPC ..... *H01F 27/362* (2013.01); *H01F 27/02* (2013.01); *H01F 27/24* (2013.01); *H01F 27/28* (2013.01); *H01F 27/32* (2013.01); *H01F 27/343* (2013.01)

(58) Field of Classification Search

CPC ..... H01F 27/00–27/36
USPC ..... 336/65, 90, 84 R, 84 C, 196
See application file for complete search history.

(56) References Cited

U.S. PATENT DOCUMENTS 2,318,068 A * 5/1943 Elsner ..... H01F 27/343 336/184
2,937,349 A * 5/1960 Camilli ..... H01F 27/324 336/197
3,327,268 A * 6/1967 Rabus ..... H01F 27/324 336/69

(Continued)

FOREIGN PATENT DOCUMENTS

JP 60-81623 U 6/1985
JP 60-113614 U 8/1985

(Continued)

*Primary Examiner* — Tuyen Nguyen
(74) *Attorney, Agent, or Firm* — Oblon, McClelland, Maier & Neustadt, L.L.P.

(57) ABSTRACT

Each of a plurality of electrostatic shields includes an insulator portion and a conductor portion. The conductor portion includes a flat portion formed in an annular shape and a pair of protruding portions. The insulator portion is provided with a first housing portion housing the flat portion and a pair of second housing portions each housing a corresponding one of the pair of protruding portions. Each of the pair of protruding portions includes: a protruding end portion located along an inner surface of a corresponding one of the pair of second housing portions, and a center portion located adjacent to the protruding end portion. In each of the pair of protruding portions, the protruding end portion and the center portion are electrically connected to each other and are equal in electric potential to each other.

6 Claims, 7 Drawing Sheets

(56) References Cited

U.S. PATENT DOCUMENTS

| | | | | |
|---|---|---|---|---|
| 5,990,775 | A * | 11/1999 | Inui | H01F 27/324 174/356 |
| 8,797,133 | B2 * | 8/2014 | Murillo | H01F 27/2885 336/84 C |
| 2008/0197977 | A1 * | 8/2008 | Wada | H01F 27/402 340/10.1 |
| 2010/0007452 | A1 * | 1/2010 | Forsberg | H01F 27/2885 336/90 |

FOREIGN PATENT DOCUMENTS

| | | |
|---|---|---|
| JP | 61-61821 U | 4/1986 |
| JP | 61-100906 | 5/1986 |
| JP | 6-69049 | 3/1994 |
| JP | 2000-164435 | 6/2000 |

* cited by examiner

STATIONARY INDUCTION APPARATUS

BACKGROUND OF THE INVENTION

Field of the Invention

The present invention relates to a stationary induction apparatus, and particularly to a stationary induction apparatus including an electrostatic shield.

Description of the Background Art

When an impulse voltage such as a lightning surge intrudes into a stationary induction apparatus such as a transformer or a reactor, the potential distribution within a winding becomes steep as compared with the potential distribution proportional to the turn number, and then, it oscillates around the potential distribution proportional to the turn number. This phenomenon is referred to as potential oscillation. When the amplitude of the potential oscillation is relatively large, a large potential difference occurs between the electric wires located adjacent to each other within the winding, and between the windings located adjacent to each other, which may cause a dielectric breakdown. When an electrostatic shield is arranged adjacent to the winding, a capacitance between the windings becomes larger than the capacitance between the winding and the ground, so that the amplitude of the potential oscillation is reduced.

As a prior art document, Japanese Utility Model Laying-Open No. 60-113614 discloses a transformer including an electrostatic shield. In the transformer disclosed in PTD 1, an electrostatic shield is provided at both ends of the winding in the central axis direction. Each of the ends of the electrostatic shield on the outer circumferential side and the inner circumferential side is formed of a curved surface.

The electrostatic shield of the transformer disclosed in Japanese Utility Model Laying-Open No. 60-113614 includes, on the side opposite to the side adjacent to a coil, an electric-field concentrating area at each of its ends on the outer and inner circumferential sides. When the electrostatic shield is configured to have a relatively large radius of curvature at each of its ends on the outer and inner circumferential sides in order to suppress the electric field concentration at each of the ends of the electrostatic shield on the outer and inner circumferential sides, the electrostatic shield is increased in thickness, so that the stationary induction apparatus is increased in size.

SUMMARY OF THE INVENTION

An object of the present invention is to provide a stationary induction apparatus capable of suppressing concentration of an electric field at each of ends of the electrostatic shield on the outer circumferential side and the inner circumferential side while suppressing thickening of the electrostatic shield.

A stationary induction apparatus according to the present invention includes: an iron core; a plurality of windings wound around the iron core as a central axis and arranged so as to be coaxial with each other; and a plurality of electrostatic shields each formed in an annular shape and each arranged adjacent to an end of a corresponding one of the plurality of windings in a direction along the central axis. Each of the plurality of electrostatic shields includes an insulator portion and a conductor portion that is disposed annularly around the central axis on an inside of the insulator portion. The conductor portion includes a flat portion formed in an annular shape and extending in a circumferential direction of the central axis, and a pair of protruding portions protruding to an opposite side to each of the windings in the direction along the central axis, the pair of protruding portions each being arranged adjacent to a corresponding one of an outer circumferential end and an inner circumferential end of the flat portion. The insulator portion is provided with a first housing portion housing the flat portion and a pair of second housing portions each housing a corresponding one of the pair of protruding portions. Each of the pair of second housing portions has an inner surface located on the opposite side to each of the windings in the direction along the central axis, the inner surface being formed in a semicircular shape in a cross-sectional view. Each of the pair of protruding portions includes a protruding end portion located along the inner surface of a corresponding one of the pair of second housing portions, and a center portion located adjacent to the protruding end portion on a side of each of the windings in the direction along the central axis. In each of the pair of protruding portions, the protruding end portion and the center portion are electrically connected to each other and are equal in electric potential to each other.

According to the present invention, it becomes possible to suppress concentration of an electric field at each of ends of the electrostatic shield on the outer circumferential side and the inner circumferential side while suppressing thickening of the electrostatic shield.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
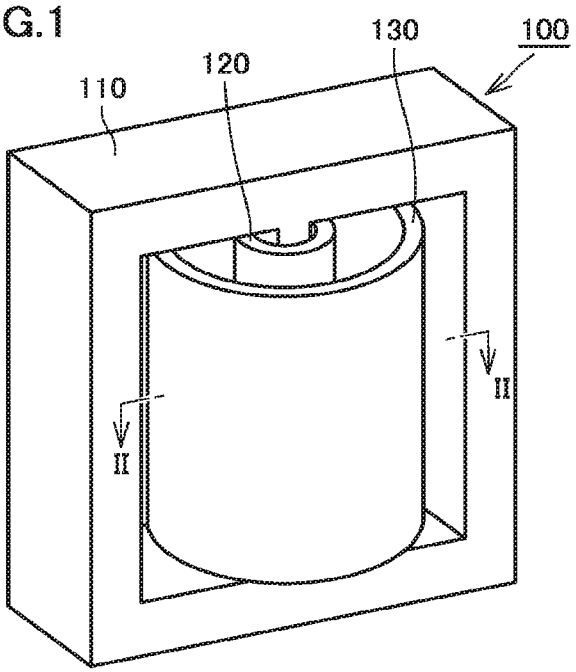
FIG. 1 is a perspective view showing an external appearance of a stationary induction apparatus according to the first embodiment of the present invention.

A stationary induction apparatus according to each embodiment of the present invention will be hereinafter described with reference to the accompanying drawings. In the following description of each embodiment, the same or corresponding components are designated by the same reference characters, and description thereof will not be repeated.

First Embodiment

Figure 2:
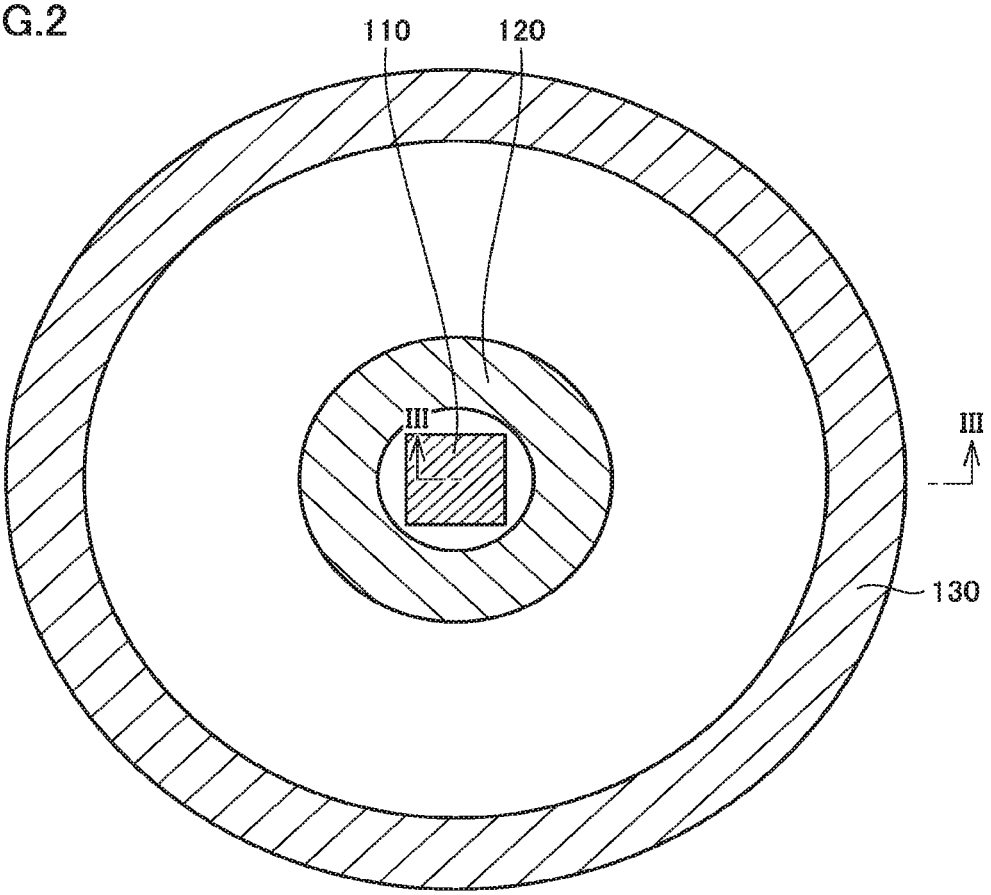
FIG. 2 is a cross-sectional view of the stationary induction apparatus according to the first embodiment of the present invention, which is seen from the direction indicated by an arrow line II-II in FIG. 1.
Figure 3:
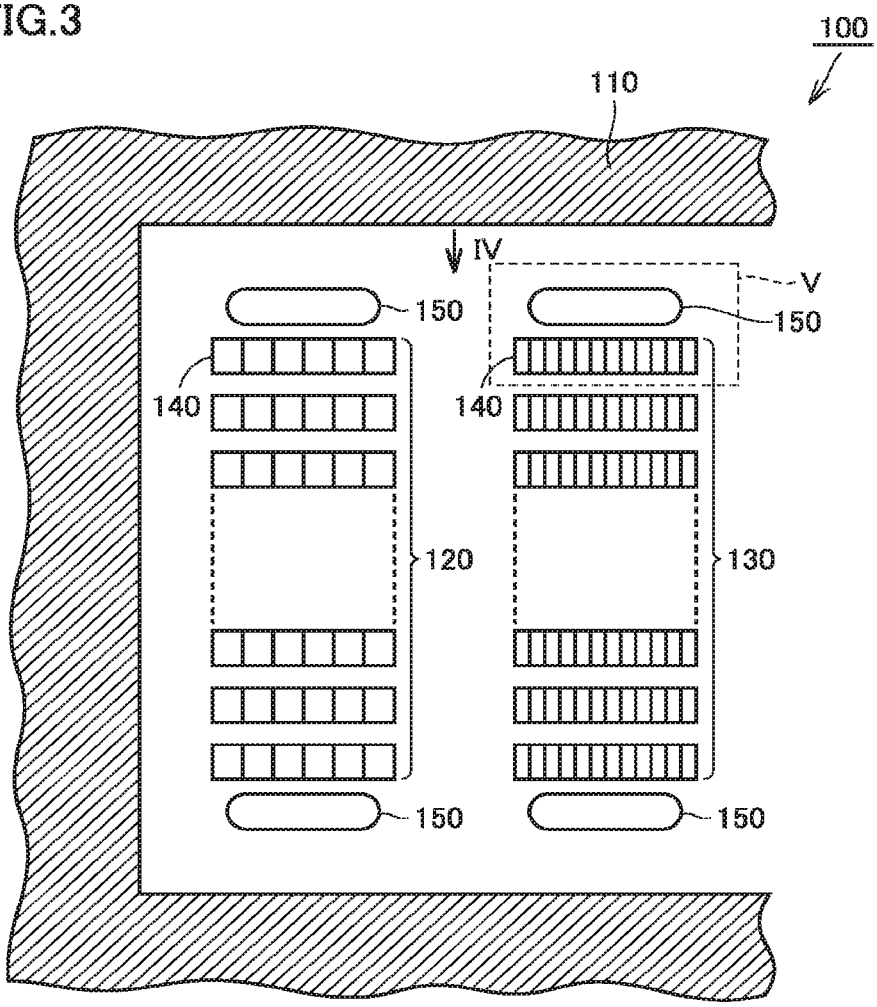
FIG. 3 is a cross-sectional view of the stationary induction apparatus according to the first embodiment of the present invention, which is seen from the direction indicated by an arrow line in FIG. 2.
Figure 4:
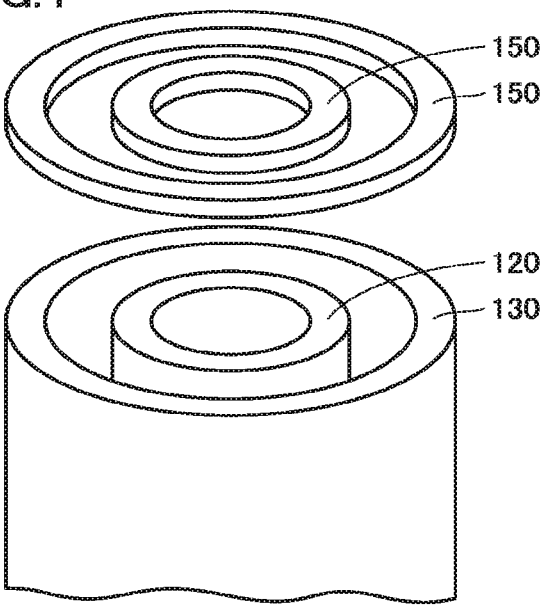
FIG. 4 is an exploded perspective view of the stationary induction apparatus according to the first embodiment of the present invention, which is seen from the direction indicated by an arrow IV in FIG. 3.
Figure 5:
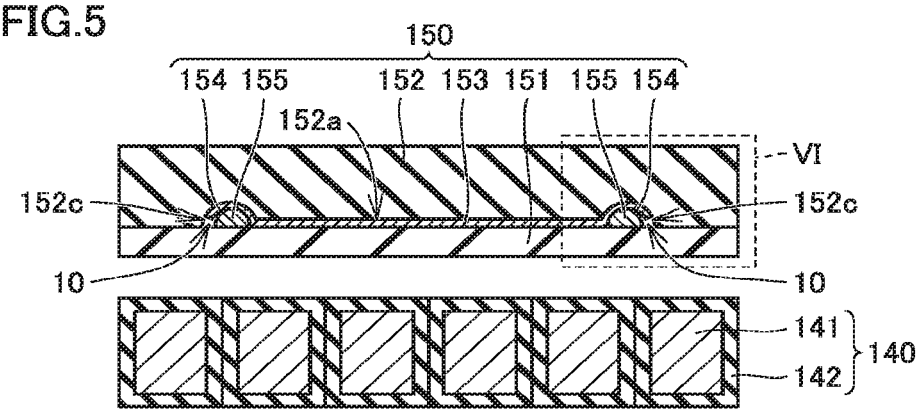
FIG. 5 is a cross-sectional view of the stationary induction apparatus according to the first embodiment of the present invention, which shows a V area in FIG. 3 in an enlarged manner.
Figure 6:
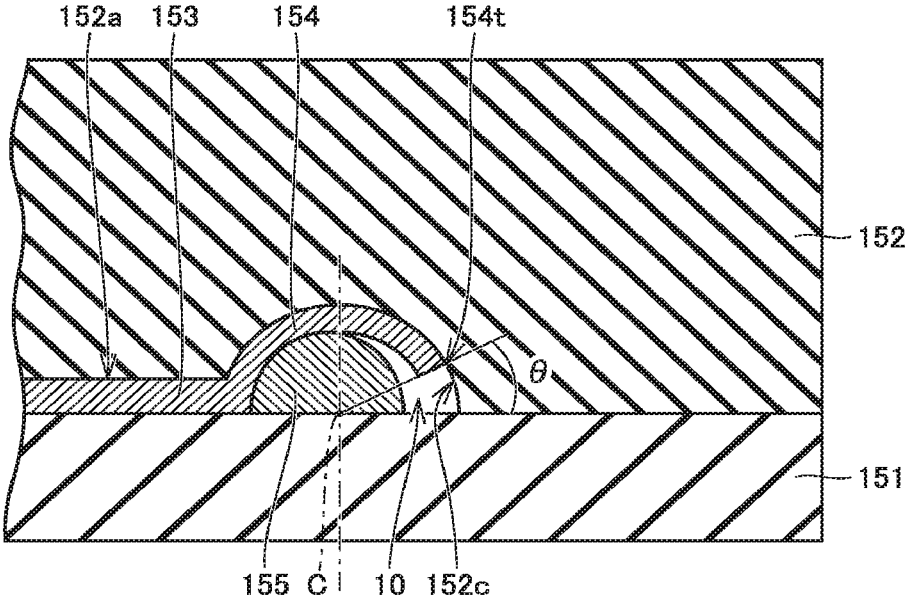
FIG. 6 is a cross-sectional view of the stationary induction apparatus according to the first embodiment of the present invention, which shows a VI area in FIG. 5 in an enlarged manner.

FIG. 1 is a perspective view showing an external appearance of a stationary induction apparatus according to the first embodiment of the present invention. FIG. 2 is a cross-sectional view of the stationary induction apparatus according to the first embodiment of the present invention, which is seen from the direction indicated by an arrow line II-II in FIG. 1. FIG. 3 is a cross-sectional view of the stationary induction apparatus according to the first embodiment of the present invention, which is seen from the direction indicated by an arrow line in FIG. 2. FIG. 4 is an exploded perspective view of the stationary induction apparatus according to the first embodiment of the present invention, which is seen from the direction indicated by an arrow IV in FIG. 3. FIG. 5 is a cross-sectional view of the stationary induction apparatus according to the first embodiment of the present invention, which shows a V area in FIG. 3 in an enlarged manner. FIG. 6 is a cross-sectional view of the stationary induction apparatus according to the first embodiment of the present invention, which shows a VI area in FIG. 5 in an enlarged manner. It is to be noted that FIG. 1 does not show an electrostatic shield, and FIG. 4 does not show an iron core.

As shown in FIGS. 1 to 6, a stationary induction apparatus 100 according to the first embodiment of the present invention is a core-type transformer. Stationary induction apparatus 100 includes: an iron core 110; and a low-voltage winding 120 and a high-voltage winding 130 that are wound around a main leg portion of iron core 110 as a central axis and that are arranged so as to be coaxial with each other.

Stationary induction apparatus 100 further includes a tank (not shown). The tank is filled with insulating oil or insulating gas that serves as an insulating medium and a cooling medium. Insulating oil is mineral oil, ester oil, or silicone oil, for example. Insulating gas is $SF_6$ gas or dry air, for example. Iron core 110, low-voltage winding 120, and high-voltage winding 130 are housed in the tank.

High-voltage winding 130 is located on the outside of low-voltage winding 120. High-voltage winding 130 is formed by stacking a plurality of disc-shaped windings in the direction along the central axis. The plurality of disc-shaped windings are formed by winding a flat wire 140 in a disc shape. Flat wire 140 includes: a wire portion 141 having a cross section formed in an approximately rectangular shape; and an insulating coating portion 142 coating wire portion 141. Although not shown, low-voltage winding 120 is similar in configuration to high-voltage winding 130.

Stationary induction apparatus 100 further includes four electrostatic shields 150 each formed in an annular shape. Each of four electrostatic shields 150 is arranged adjacent to a corresponding one of ends of low-voltage winding 120 and high-voltage winding 130 in the direction along the central axis. Each of four electrostatic shields 150 is electrically connected to a line end of adjacent low-voltage winding 120 or a line end of adjacent high-voltage winding 130, and is approximately equal in electric potential thereto. In addition to the purpose of reducing the amplitude of the potential oscillation, each of four electrostatic shields 150 is provided for the purpose of suppressing concentration of an electric field at each of the ends of low-voltage winding 120 and high-voltage winding 130 in the direction along the central axis.

Each of four electrostatic shields 150 includes an insulator portion and a conductor portion that is disposed annularly around the central axis on the inside of the insulator portion. The conductor portion includes: a flat portion 153 formed in an annular shape and extending in the circumferential direction of the central axis; and a pair of protruding portions protruding to the opposite side to each winding in the direction along the central axis. The pair of protruding portions each are arranged adjacent to a corresponding one of the outer circumferential end and the inner circumferential end of flat portion 153. Flat portion 153 and the pair of protruding portions are electrically connected to each other.

The conductor portion in each of four electrostatic shields 150 is provided with slits at one or more portions so as to extend discontinuously in the circumferential direction. These slits can prevent a flow of a current that circulates through the entire circumference of each electrostatic shield 150. In the present embodiment, slits are not provided in the insulator portion in each of four electrostatic shields 150, but slits only have to be provided at positions in each electrostatic shield 150, which are located to correspond to the slits in the conductor portion.

In the present embodiment, the insulator portion is formed of: a first insulator portion 151 located on the winding side in the direction along the central axis; and a second insulator portion 152 located on the opposite side to the winding in the direction along the central axis. First insulator portion 151 and second insulator portion 152 are bonded to each other with an adhesive that is applied over the entire surfaces of these insulator portions that face each other.

First insulator portion 151 and second insulator portion 152 each has an approximately rectangular outer shape in a cross-sectional view, but may have a curved portion in a cross-sectional view. It is to be noted that first insulator portion 151 and second insulator portion 152 each having a rectangular outer shape can be more easily produced and can more easily hold electrostatic shield 150.

The insulator portion is provided with a first housing portion 152*a* housing flat portion 153 and a pair of second housing portions 152*c* each housing a corresponding one of the pair of protruding portions. In the present embodiment, second insulator portion 152 is provided with an annular groove portion serving as first housing portion 152*a* and the pair of second housing portions 152*c*. First housing portion 152*a* is filled with flat portion 153.

Each of the pair of second housing portions 152*c* has an inner surface located on the opposite side to the winding in the direction along the central axis. This inner surface is formed in a semicircular shape in a cross-sectional view. In addition, the semicircular shape also includes a semi-elliptical shape close to a semicircular shape.

Each of the pair of protruding portions in the conductor portion includes: a protruding end portion 154 located along the inner surface of a corresponding one of the pair of second housing portions 152*c*; and a center portion 155 located adjacent to protruding end portion 154 on the winding side in the direction along the central axis. In the present embodiment, in a cross-sectional view, protruding end portion 154 is formed in an arc shape while center portion 155 is formed in a semicircular shape. In each of the pair of protruding portions, center portion 155 is sandwiched between protruding end portion 154 and first insulator portion 151.

As shown in FIG. 6, the inner surface of each of the pair of second housing portions 152*c* that is located on the opposite side to the winding in the direction along the central axis is covered by protruding end portion 154 such that three-quarters or more of a semicircle of the inner surface is covered in a cross-sectional view. In other words, in a cross-sectional view, an angle θ of less than 45° is formed between: a straight line connecting a center point C on the inner surface of each of the pair of second housing portions 152*c* and a tip end 154*t* of protruding end portion 154; and a boundary line between first insulator portion 151 and second insulator portion 152.

Each of the pair of second housing portions 152*c* has a space 10 in which protruding end portion 154 and center portion 155 are not located. This space 10 is filled with insulating oil or insulating gas within the tank. In other words, the conductor portion is surrounded by first insulator portion 151, second insulator portion 152, and the insulating oil or the insulating gas within space 10. In addition, each of first insulator portion 151 and second insulator portion 152 is higher in dielectric strength than each of the insulating oil and the insulating gas.

In each of the pair of protruding portions, protruding end portion 154 and center portion 155 are electrically connected to each other and are approximately equal in electric potential to each other. Specifically, at a connection portion (not shown), protruding end portion 154 and center portion 155 are connected to a line end of adjacent low-voltage winding 120 or a line end of adjacent high-voltage winding 130.

Each of first insulator portion 151 and second insulator portion 152 is formed of a pressboard or compressed laminated wood. First insulator portion 151 and second insulator portion 152 may be made of the same material or may be made of different materials. In the present embodiment, the material forming second insulator portion 152 is less in relative permittivity than the material forming first insulator portion 151.

Flat portion 153 and protruding end portion 154 each are formed of a metal wire mesh, metal foil, a conductive tape, or a conductive coating material. Center portion 155 is formed of a bare wire, a covered electric wire, or a conductive coating material. In the present embodiment, flat portion 153 and protruding end portion 154 each are formed of a conductive coating material. Center portion 155 is formed of a shield wire made of a bare wire or a covered electric wire.

In the case where protruding end portion 154 is formed of a conductive coating material, if the conductive coating material overflows second housing portion 152*c*, an electric field concentrates on the portion across which the conductive coating material overflows, thereby causing a weak point therein in terms of insulation. Accordingly, it is necessary to prevent an overflow of the conductive coating material from second housing portion 152*c*. Thus, in the present embodiment, a portion not covered by protruding end portion 154 is intentionally provided in the inner surface of each of the pair of second housing portions 152*c*, as shown in FIG. 6.

In order to reduce the amplitude of the potential oscillation, electrostatic shield 150 needs to be equal in electric potential to low-voltage winding 120 or high-voltage winding 130 that is located adjacent to electrostatic shield 150 when an impulse voltage intrudes into stationary induction apparatus 100. If the conductor portion has relatively high electrical resistivity, the following performance of the electric potential in electrostatic shield 150 may slow down, with the result that the potential oscillation may be unable to be sufficiently suppressed. Accordingly, it is preferable that the surface resistivity of the conductor portion is 10 Ω/sq or more and 50 Ω/sq or less.

In electrostatic shield 150 according to the present embodiment, protruding end portion 154 and center portion 155 are electrically connected to each other and are approximately equal in electric potential to each other. Accordingly, it becomes possible to suppress concentration of an electric field on the contact portion between protruding end portion 154 and center portion 155, and also possible to suppress concentration of an electric field in space 10. Furthermore, since electrostatic shield 150 is approximately equal in electric potential to low-voltage winding 120 or high-voltage winding 130 that is located adjacent to electrostatic shield 150, it becomes possible to suppress concentration of an electric field on the contact portion between center portion 155 and first insulator portion 151.

The following is an explanation about the reason why electrostatic shield 150 according to the present embodiment can suppress concentration of an electric field at each of the ends of electrostatic shield 150 on the outer circumferential side and the inner circumferential side while suppressing the electrostatic shield from thickening as compared with the conventional electrostatic shield.

In general, the strength of the electric field generated in the conductor portion is decreased as the distance from the conductor portion applied with a high voltage is increased. The smaller the radius of curvature is set at each of the ends of the conductor portion on the outer and inner circumferential sides, the greater the effect is achieved for reducing the electric field strength by the distance from the conductor portion. In the conventional electrostatic shield, it was difficult to provide a thick insulating coating for covering the entire surface of the conductor portion in terms of production. Accordingly, in order to suppress concentration of an electric field generated in the vicinity of the surface of each of the ends of the electrostatic shield on the outer and inner circumferential sides, the radius of curvature of each of the ends of the conductor portion on the outer and inner circumferential sides has been set to be relatively large.

In electrostatic shield 150 according to the present embodiment, the conductor portion is covered by first insulator portion 151 and second insulator portion 152 that are higher in dielectric strength than each of insulating oil and insulating gas. Thus, in electrostatic shield 150 according to the present embodiment, the radius of curvature of each of the ends of the conductor portion on the outer and inner circumferential sides can be set to be smaller than those in the conventional electrostatic shield. Specifically, the radius of curvature of protruding end portion 154 can be set to be relatively small. This can increase the effect of reducing the electric field strength achieved by the distance from the conductor portion, so that the electric field strength at each of the ends of electrostatic shield 150 on the outer and inner circumferential sides can be reduced.

As described above, in stationary induction apparatus 100 according to the present embodiment, electrostatic shield 150 can suppress concentration of an electric field at each of the ends of electrostatic shield 150 on the outer and inner circumferential sides, and also can reduce the amplitude of the potential oscillation. Furthermore, it is not necessary to thicken electrostatic shield 150. In other words, stationary induction apparatus 100 can suppress concentration of an electric field at each of the ends of electrostatic shield 150 on the outer and inner circumferential sides while suppressing thickening of electrostatic shield 150.

In stationary induction apparatus 100 according to the present embodiment, the material forming second insulator portion 152 is less in relative permittivity than the material forming first insulator portion 151, thereby further increasing the effect of reducing the electric field strength achieved by the distance from the conductor portion. Consequently, it becomes possible to further reduce the electric field strength at each of the ends of electrostatic shield 150 on the outer and inner circumferential sides.

Figure 7:
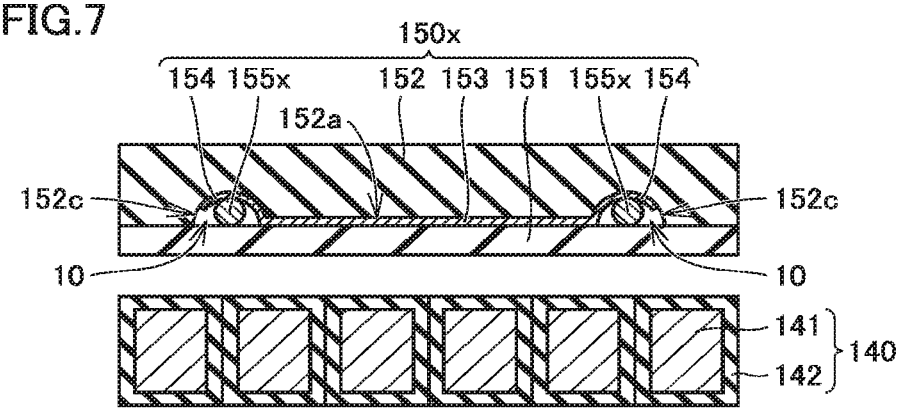
FIG. 7 is a cross-sectional view of a stationary induction apparatus according to a modification of the first embodiment of the present invention.

In stationary induction apparatus 100 according to the present embodiment, in a cross-sectional view, center portion 155 is formed in a semicircular shape, but may be formed in a circular shape. FIG. 7 is a cross-sectional view of a stationary induction apparatus according to a modification of the first embodiment of the present invention. FIG. 7 shows a cross-sectional view seen from the same direction as that in FIG. 5.

As shown in FIG. 7, in an electrostatic shield 150*x* of a stationary induction apparatus according to the modification of the first embodiment of the present invention, a pair of protruding portions in the conductor portion each includes: a protruding end portion 154 located along the above-described inner surface of a corresponding one of the pair of second housing portions 152*c*; and a center portion 155*x* located adjacent to protruding end portion 154 on the winding side in the direction along the above-described central axis. In the present modification, in a cross-sectional view, protruding end portion 154 is formed in an arc shape and center portion 155*x* is formed in a circular shape. In each of the pair of protruding portions, center portion 155*x* is sandwiched between protruding end portion 154 and first insulator portion 151.

In the present modification, center portion 155*x* can be formed by a shield wire having a round shape in a cross-sectional view, so that electrostatic shield 150*x* can be readily produced. Also in the stationary induction apparatus according to the present modification, electrostatic shield 150*x* can suppress concentration of an electric field at each of the ends of electrostatic shield 150*x* on the outer and inner circumferential sides and also can reduce the amplitude of the potential oscillation. Furthermore, it is not necessary to thicken electrostatic shield 150*x*. In other words, in the stationary induction apparatus according to the modification, it becomes possible to suppress concentration of an electric field at each of the ends of electrostatic shield 150*x* on the outer and inner circumferential sides while suppressing thickening of electrostatic shield 150*x*.

Second Embodiment

A stationary induction apparatus according to the second embodiment of the present invention will be hereinafter described. The stationary induction apparatus according to the present embodiment is different only in electrostatic shield configuration from the stationary induction apparatus according to the first embodiment. Thus, the same configurations as those of the stationary induction apparatus according to the first embodiment will be designated by the same reference characters, and the description thereof will not be repeated.

Figure 8:
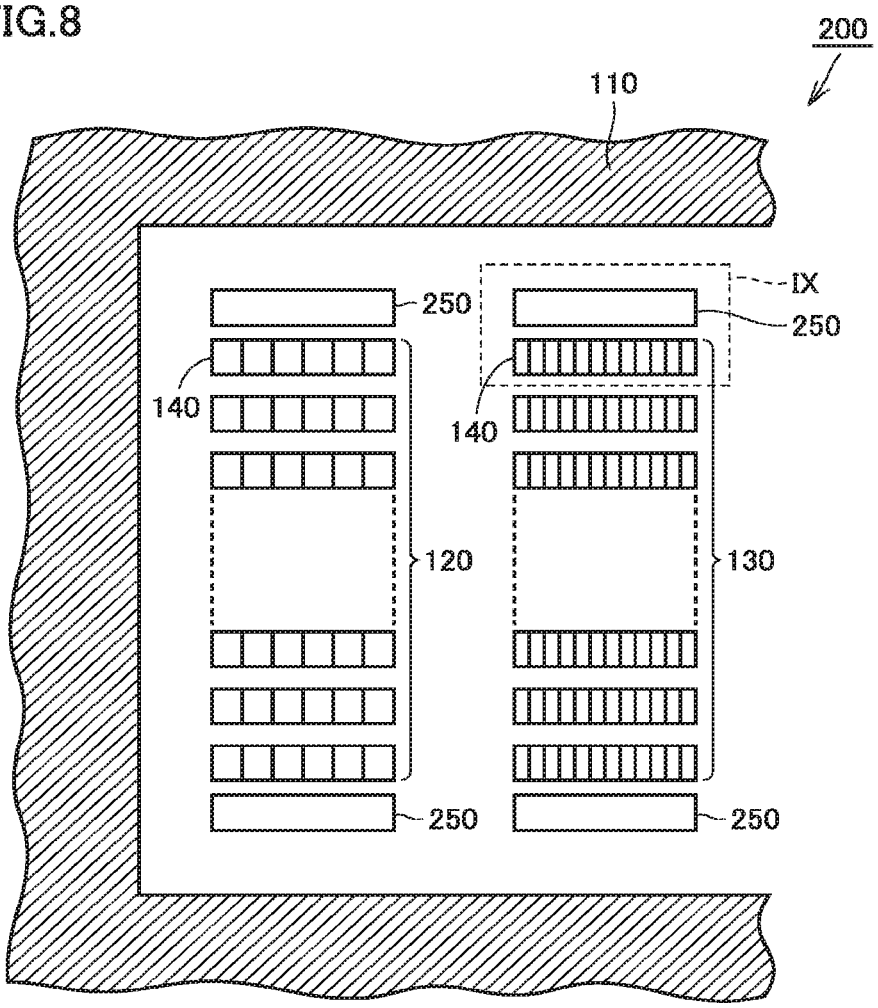
FIG. 8 is a cross-sectional view of a stationary induction apparatus according to the second embodiment of the present invention.
Figure 9:
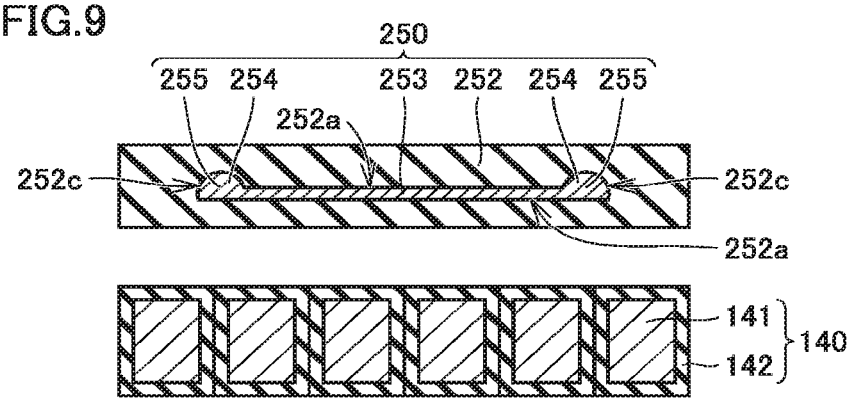
FIG. 9 is a cross-sectional view of the stationary induction apparatus according to the second embodiment of the present invention, which shows an IX area in FIG. 8 in an enlarged manner.

FIG. 8 is a cross-sectional view of a stationary induction apparatus according to the second embodiment of the present invention. FIG. 8 is a view shown in the same cross section as that in FIG. 3. FIG. 9 is a cross-sectional view of the stationary induction apparatus according to the second embodiment of the present invention, which shows an IX area in FIG. 8 in an enlarged manner.

As shown in FIGS. 8 and 9, a stationary induction apparatus 200 according to the second embodiment of the present invention includes four electrostatic shields 250 each formed in an annular shape and each arranged adjacent to a corresponding one of ends of a low-voltage winding 120 and a high-voltage winding 130 in the direction along the above-described central axis.

Each of four electrostatic shields 250 is electrically connected to a line end of adjacent low-voltage winding 120 or a line end of adjacent high-voltage winding 130, and are approximately equal in electric potential thereto. In addition to the purpose of reducing the amplitude of the potential oscillation, each of four electrostatic shields 250 is disposed for the purpose of suppressing concentration of an electric field at a corresponding one of the ends of low-voltage winding 120 and high-voltage winding 130 in the direction along the central axis.

Each of four electrostatic shields 250 includes an insulator portion 252 and a conductor portion that is disposed annularly around the central axis on the inside of insulator portion 252. The conductor portion includes: a flat portion 253 formed in an annular shape and extending in the circumferential direction of the central axis; and a pair of protruding portions each arranged adjacent to a corresponding one of the outer circumferential end and the inner circumferential end of flat portion 253. The pair of protruding portions protrudes to the opposite side to the winding in the direction along the central axis. In the present embodiment, flat portion 253 and the pair of protruding portions are formed as an integrated component, but flat portion 253 and the pair of protruding portions may be formed separately from each other.

Insulator portion 252 has an approximately rectangular outer shape in a cross-sectional view, but may have a curved portion in a cross-sectional view. It is to be noted that insulator portion 252 having a rectangular outer shape can be more simply and readily produced and can more easily hold electrostatic shield 250. In the present embodiment, insulator portion 252 is integrally formed. However, the insulator portion may be formed of the first insulator portion and the second insulator portion similar to electrostatic shield 150 according to the first embodiment.

Insulator portion 252 is provided with a first housing portion 252*a* housing flat portion 253 and a pair of second housing portions 252*c* each housing a corresponding one of the pair of protruding portions. In the present embodiment, insulator portion 252 is provided with an annular hole portion serving as first housing portion 252*a* and the pair of second housing portions 252*c*.

First housing portion 252*a* is filled with flat portion 253. Each of the pair of second housing portions 252*c* is filled with a corresponding one of the pair of protruding portions.

In other words, the conductor portion is covered by insulator portion 252. Accordingly, in the present embodiment, each of the pair of second housing portions 252*c* does not include a space in which a conductor portion is not located. In addition, insulator portion 252 is higher in dielectric strength than each of insulating oil and insulating gas.

Each of the pair of second housing portions 252*c* has an inner surface located on the opposite side to the winding in the direction along the central axis. This inner surface is formed in a semicircular shape in a cross-sectional view. In addition, the semicircular shape also includes a semi-elliptical shape close to a semicircular shape.

Each of the pair of protruding portions in the conductor portion includes: a protruding end portion 254 located along the inner surface of a corresponding one of the pair of second housing portions 252*c*; and a center portion 255 located adjacent to protruding end portion 154 on the winding side in the direction along the central axis. In the present embodiment, in a cross-sectional view, protruding end portion 254 is formed in a semi-arc shape while center portion 255 is formed in a semicircular shape. In each of the pair of protruding portions, center portion 255 is sandwiched between protruding end portion 254 and insulator portion 252. In the present embodiment, protruding end portion 254 and center portion 255 are formed as an integrated component, but protruding end portion 254 and center portion 255 may be formed separately from each other.

Insulator portion 252 is made of thermosetting resin such as epoxy resin. The conductor portion is made of metal such as copper, stainless steel or aluminum, or an alloy thereof. Electrostatic shield 250 is formed, for example, by the insert casting method.

In order to reduce the amplitude of the potential oscillation, electrostatic shield 250 needs to be equal in electric potential to low-voltage winding 120 or high-voltage winding 130 that is located adjacent to electrostatic shield 250 when an impulse voltage intrudes into stationary induction apparatus 200. If the conductor portion has relatively high electrical resistivity, the following performance of the electric potential in electrostatic shield 250 may slow down, with the result that the potential oscillation may be unable to be sufficiently suppressed. Accordingly, it is preferable that the surface resistivity of the conductor portion is 10 Ω/sq or more and 50 Ω/sq or less.

In electrostatic shield 250 according to the present embodiment, the conductor portion is covered by insulator portion 252 that is higher in dielectric strength than each of insulating oil and insulating gas. Thus, in electrostatic shield 250 according to the present embodiment, the radius of curvature of each of the ends of the conductor portion on the outer and inner circumferential sides can be set to be smaller than those in the conventional electrostatic shield. Specifically, the radius of curvature of protruding end portion 254 can be set to be relatively small. This can increase the effect of reducing the electric field strength achieved by the distance from the conductor portion, so that the electric field strength at each of the ends of electrostatic shield 250 on the outer and inner circumferential sides can be reduced.

As described above, also in stationary induction apparatus 200 according to the second embodiment of the present invention, electrostatic shield 250 can suppress concentration of an electric field at each of the ends of electrostatic shield 250 on the outer and inner circumferential sides, and also can reduce the amplitude of the potential oscillation. Furthermore, it is not necessary to thicken electrostatic shield 250. In other words, in stationary induction apparatus 200 according to the second embodiment of the present invention, it becomes possible to suppress concentration of an electric field at each of the ends of electrostatic shield 250 on the outer and inner circumferential sides while suppressing thickening of electrostatic shield 250.

Figure 10:
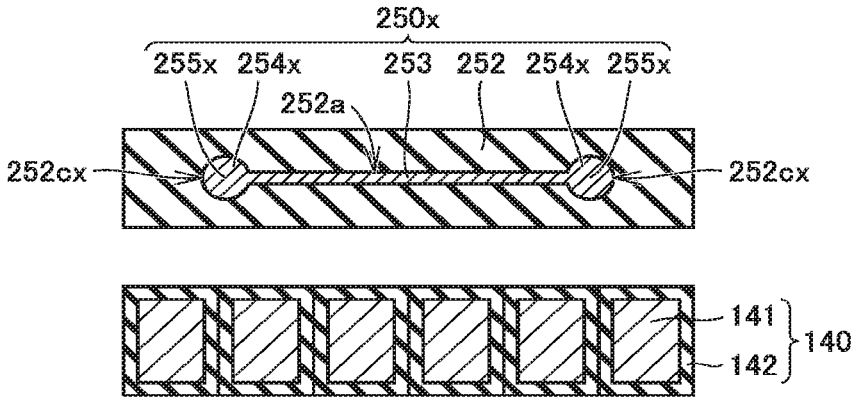
FIG. 10 is a cross-sectional view of a stationary induction apparatus according to a modification of the second embodiment of the present invention.

In stationary induction apparatus 200 according to the present embodiment, in a cross-sectional view, center portion 255 is formed in a semicircular shape, but may be formed in a circular shape. FIG. 10 is a cross-sectional view of a stationary induction apparatus according to a modification of the second embodiment of the present invention. FIG. 10 shows a cross-sectional view seen from the same direction as that in FIG. 9.

As shown in FIG. 10, in electrostatic shield 250*x* of the stationary induction apparatus according to the modification of the second embodiment of the present invention, each of the pair of protruding portions in the conductor portion also protrudes toward the winding in the direction along the above-described central axis. Thus, the inner surface of each of the pair of second housing portions 252*cx* is formed in a circular shape in a cross-sectional view. It is to be noted that a circular shape also includes an elliptical shape close to a circular shape.

Each of the pair of protruding portions in the conductor portion includes: a protruding end portion 254*x* located along the inner surface of a corresponding one of the pair of second housing portions 252*cx*; and a center portion 255*x* located adjacent to protruding end portion 254*x*. In the present modification, in a cross-sectional view, protruding end portion 254*x* is formed in a circular annular shape while center portion 255*x* is formed in a circular shape. In each of the pair of protruding portions, center portion 255*x* is surrounded by protruding end portion 254*x*.

As compared with electrostatic shield 250 of stationary induction apparatus 200 according to the second embodiment of the present invention, electrostatic shield 250*x* according to the present modification can suppress occurrence of peeling at the interface between the conductor portion and insulator portion 252, which is located on the winding side in the direction along the above-described central axis. Thereby, the insulation reliability of electrostatic shield 250*x* can be improved.

Third Embodiment

A stationary induction apparatus according to the third embodiment of the present invention will be hereinafter described. The stationary induction apparatus according to the present embodiment is mainly different from the stationary induction apparatus according to the first embodiment in that it is a shell-type transformer. Thus, the description of the same configuration as that of the stationary induction apparatus according to the first embodiment will not be repeated.

Figure 11:
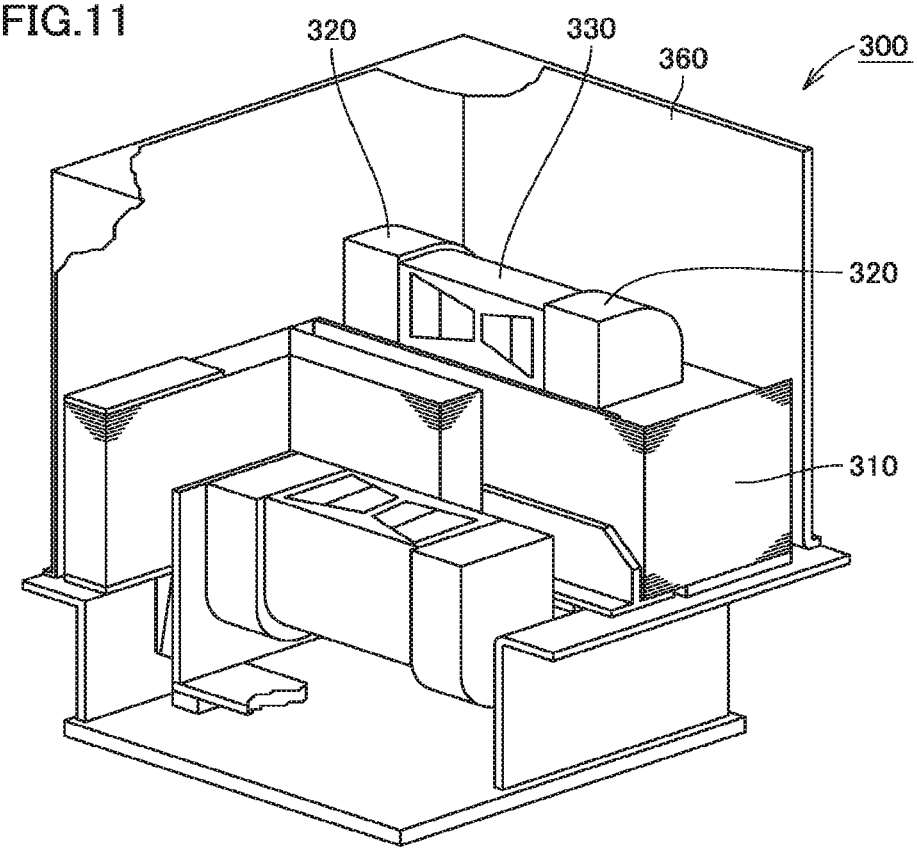
FIG. 11 is a perspective view showing an external appearance of a stationary induction apparatus according to the third embodiment of the present invention.
Figure 12:
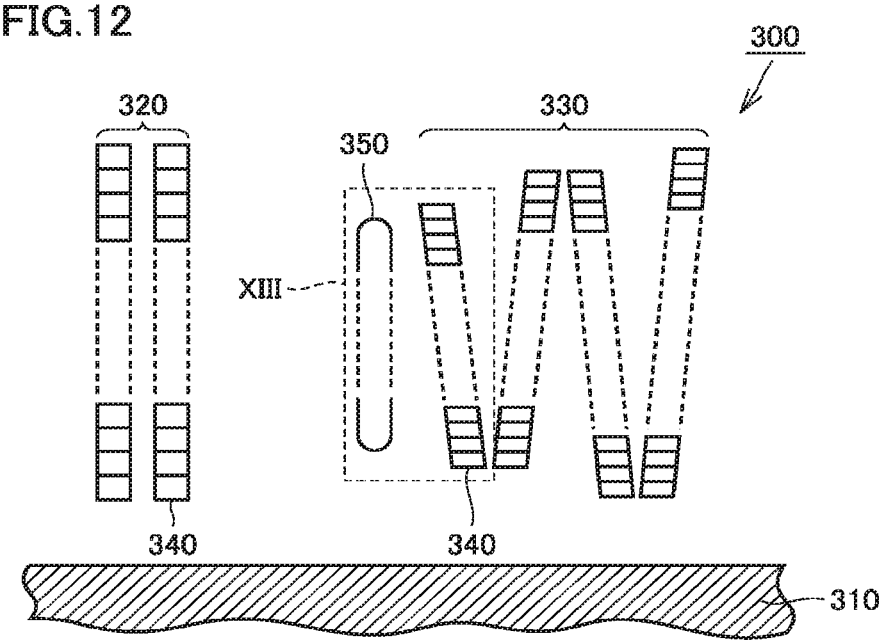
FIG. 12 is a partial cross-sectional view of the stationary induction apparatus according to the third embodiment of the present invention.
Figure 13:
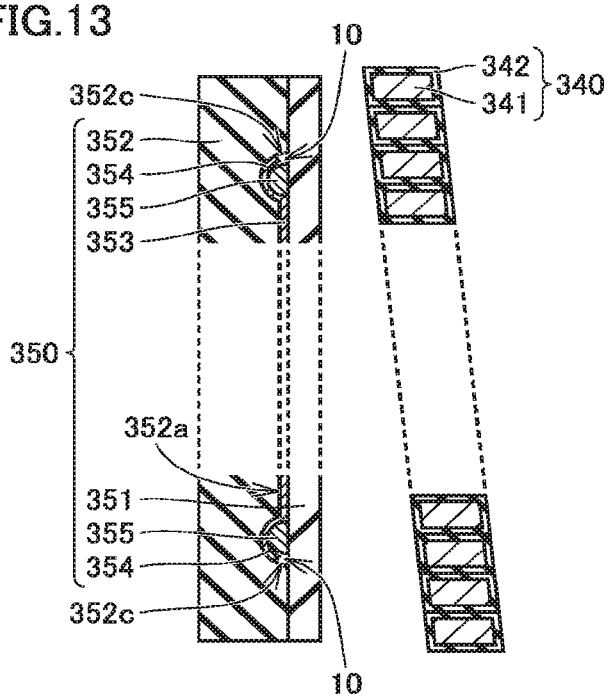
FIG. 13 is a cross-sectional view of the stationary induction apparatus according to the third embodiment of the present invention, which shows a XIII area in FIG. 12 in an enlarged manner.

FIG. 11 is a perspective view showing an external appearance of a stationary induction apparatus according to the third embodiment of the present invention. FIG. 12 is a partial cross-sectional view of the stationary induction apparatus according to the third embodiment of the present invention. FIG. 13 is a cross-sectional view of the stationary induction apparatus according to the third embodiment of the present invention, which shows a XIII area in FIG. 12 in an enlarged manner. FIG. 11 does not show an electrostatic shield. FIG. 12 shows only an area above the iron core.

As shown in FIGS. 11 to 13, a stationary induction apparatus 300 according to the third embodiment of the present invention is a shell-type transformer. Stationary induction apparatus 300 includes: an iron core 310; and a low-voltage winding 320 and a high-voltage winding 330 that are wound around a main leg portion of iron core 310 as a central axis and that are arranged to be coaxial with each other.

Stationary induction apparatus 300 further includes a tank 360. Tank 360 is filled with insulating oil or insulating gas serving as an insulating medium and a cooling medium. Insulating oil is mineral oil, ester oil, or silicone oil, for example. Insulating gas is $SF_6$ gas or dry air, for example. Iron core 310, low-voltage winding 320 and high-voltage winding 330 are housed in tank 360.

High-voltage winding 330 is arranged so as to be sandwiched between low-voltage windings 320 in the direction along the above-described central axis. High-voltage winding 330 is formed by stacking a plurality of disc-shaped windings in the axial direction along the central axis. The plurality of disc-shaped windings are formed by winding a flat wire 340 in a disc shape. Flat wire 340 includes a wire portion 341 having a cross section formed in an approximately rectangular shape and an insulating coating portion 342 coating wire portion 341. Although not shown, low-voltage winding 320 is similar in configuration to high-voltage winding 330.

Stationary induction apparatus 300 further includes a plurality of electrostatic shields 350 each formed in an annular shape. Each of the plurality of electrostatic shields 350 is arranged adjacent to a corresponding one of ends of low-voltage winding 320 and high-voltage winding 330 in the direction along the central axis. FIG. 12 shows only one electrostatic shield 350 located adjacent to high-voltage winding 330.

Each of four electrostatic shields 350 includes an insulator portion and a conductor portion that is disposed annularly around the central axis on the inside of the insulator portion. The conductor portion includes: a flat portion 353 formed in an annular shape and extending in the circumferential direction of the central axis; and a pair of protruding portions each arranged adjacent to a corresponding one of the outer circumferential end and the inner circumferential end of flat portion 353. The pair of protruding portions protrudes to the opposite side to the winding in the direction along the central axis. Flat portion 353 and the pair of protruding portions are electrically connected to each other.

The conductor portion in each of four electrostatic shields 350 is provided with slits at one or more portions so as to extend discontinuously in the circumferential direction. These slits can prevent a flow of a current that circulates through the entire circumference of electrostatic shield 350. In the present embodiment, slits are not provided in the insulator portion in each of four electrostatic shields 350, but slits only have to be provided at positions in each electrostatic shield 350, which are located to correspond to the slits in the conductor portion.

In the present embodiment, the insulator portion is formed of: a first insulator portion 351 located on the winding side in the direction along the above-described central axis; and a second insulator portion 352 located on the opposite side to the winding in the direction along the above-described central axis. First insulator portion 351 and second insulator portion 352 are bonded to each other with an adhesive applied over the entire surfaces of these insulator portions that face each other.

First insulator portion 351 and second insulator portion 352 each have an approximately rectangular outer shape in a cross-sectional view, but each may have a curved portion in a cross-sectional view. It is to be noted that first insulator portion 351 and second insulator portion 352 each having a rectangular outer shape can be more simply and readily produced and can more easily hold electrostatic shield 350.

The insulator portion is provided with a first housing portion 352*a* housing flat portion 353 and a pair of second housing portions 352*c* each housing a corresponding one of the pair of protruding portions. In the present embodiment, second insulator portion 352 is provided with an annular groove portion serving as first housing portion 352*a* and the pair of second housing portions 352*c*. First housing portion 352*a* is filled with flat portion 353.

Each of the pair of second housing portions 352*c* has an inner surface located on the opposite side to the winding in the direction along the central axis. The inner surface is formed in a semicircular shape in a cross-sectional view. In addition, the semicircular shape also includes a semi-elliptical shape close to a semicircular shape.

Each of the pair of protruding portions in the conductor portion includes: a protruding end portion 354 located along the inner surface of a corresponding one of the pair of second housing portions 152*c*; and a center portion 355 located adjacent to protruding end portion 354 on the winding side in the direction along the central axis. In the present embodiment, in a cross-sectional view, protruding end portion 354 is formed in an arc shape while center portion 355 is formed in a semicircular shape. In each of the pair of protruding portions, center portion 355 is sandwiched between protruding end portion 354 and first insulator portion 351.

The inner surface of each of the pair of second housing portions 352*c* that is located on the opposite side to the winding in the direction along the central axis is covered by protruding end portion 354 such that three-quarters or more of a semicircle of the inner surface is covered in a cross-sectional view. In other words, in a cross-sectional view, an angle of less than 45° is formed between: a straight line connecting the center point on the inner surface of each of the pair of second housing portions 352*c* and the tip end of protruding end portion 354; and a boundary line between first insulator portion 351 and second insulator portion 352.

Each of the pair of second housing portions 352*c* has a space 10 in which protruding end portion 354 and center portion 355 are not located. This space 10 is filled with insulating oil or insulating gas within tank 360. In other words, the conductor portion is surrounded by first insulator portion 351, second insulator portion 352, and the insulating oil or the insulating gas within space 10. In addition, each of first insulator portion 351 and second insulator portion 352 is higher in dielectric strength than each of the insulating oil and the insulating gas.

In each of the pair of protruding portions, protruding end portion 354 and center portion 355 are electrically connected to each other and are approximately equal in electric potential to each other. Specifically, at a connection portion (not shown), protruding end portion 354 and center portion 355 are connected to a line end of adjacent low-voltage winding 320 or a line end of adjacent high-voltage winding 330.

Each of first insulator portion 351 and second insulator portion 352 is formed of a pressboard or compressed laminated wood. First insulator portion 351 and second insulator portion 352 may be made of the same material or may be made of different materials. In the present embodiment, the material forming second insulator portion 352 is less in relative permittivity than the material forming first insulator portion 351.

Flat portion 353 and protruding end portion 354 each are formed of a metal wire mesh, metal foil, a conductive tape, or a conductive coating material. Center portion 355 is formed of a bare wire, a covered electric wire, or a conductive coating material. In the present embodiment, flat portion 353 and protruding end portion 354 each are formed of a conductive coating material. Center portion 355 is formed of a shield wire made of a bare wire or a covered electric wire.

In addition, in the case where protruding end portion 354 is formed of a conductive coating material, if the conductive coating material overflows second housing portion 352*c*, an electric field concentrates on the portion across which the conductive coating material overflows, thereby causing a weak point therein in terms of insulation. Accordingly, it is necessary to prevent an overflow of the conductive coating material from second housing portion 352*c*. Thus, in the present embodiment, a portion not covered by protruding end portion 354 is intentionally provided in the inner surface of each of the pair of second housing portions 352*c*, as shown in FIG. 13.

In order to reduce the amplitude of the potential oscillation, electrostatic shield 350 needs to be equal in electric potential to low-voltage winding 320 or high-voltage winding 330 that is located adjacent to electrostatic shield 350 when an impulse voltage intrudes into stationary induction apparatus 300. If the conductor portion has relatively high electrical resistivity, the following performance of the electric potential in electrostatic shield 350 may slow down, with the result that the potential oscillation may be unable to be sufficiently suppressed. Accordingly, it is preferable that the surface resistivity of the conductor portion is 10 Ω/sq or more and 50 Ω/sq or less.

In electrostatic shield 350 according to the present embodiment, protruding end portion 354 and center portion 355 are electrically connected to each other and are approximately equal in electric potential to each other. Accordingly, it becomes possible to suppress concentration of an electric field on the contact portion between protruding end portion 354 and center portion 355, and also possible to suppress concentration of an electric field in space 10. Furthermore, since electrostatic shield 350 is approximately equal in electric potential to low-voltage winding 320 or high-voltage winding 330 that is located adjacent to electrostatic shield 350, it becomes possible to suppress concentration of an electric field on the contact portion between center portion 355 and first insulator portion 351.

In electrostatic shield 350 according to the present embodiment, the conductor portion is covered by first insulator portion 351 and second insulator portion 352 that are higher in dielectric strength than each of insulating oil and insulating gas. Therefore, in electrostatic shield 350 according to the present embodiment, the radius of curvature of each of the ends of the conductor portion on the outer and inner circumferential sides can be set smaller than those in the conventional electrostatic shield. Specifically, the radius of curvature of protruding end portion 354 can be set relatively small. Thereby, since the effect of reducing the electric field strength achieved by the distance from the conductor portion is increased, the electric field strength at each of the ends of electrostatic shield 350 on the outer and inner circumferential sides can be reduced.

As described above, also in stationary induction apparatus 300 according to the present embodiment, electrostatic shield 350 can suppress concentration of an electric field at each of the ends of electrostatic shield 350 on the outer and inner circumferential sides and also can reduce the amplitude of the potential oscillation. Furthermore, it is not necessary to thicken electrostatic shield 350. In other words, in stationary induction apparatus 300, it becomes possible to suppress concentration of an electric field at each of the ends of electrostatic shield 350 on the outer and inner circumferential sides while suppressing thickening of electrostatic shield 350.

In stationary induction apparatus 300 according to the present embodiment, the material forming second insulator portion 352 is less in relative permittivity than the material forming first insulator portion 351, thereby further increasing the effect of reducing the electric field strength achieved by the distance from the conductor portion. Consequently, it becomes possible to further reduce the electric field strength at each of the ends of electrostatic shield 350 on the outer and inner circumferential sides.

In addition, the configuration of electrostatic shield 350 it not limited to those as described above, but may be the same as the configuration of the modification described in the first embodiment, the configuration of the second embodiment, or the configuration of the modification described in the second embodiment.

In the description of the embodiments set forth above, a core-type transformer and a shell-type transformer have been described as a stationary induction apparatus, but the stationary induction apparatus may be other types of stationary induction apparatuses such as a reactor.

Although the embodiments of the present invention have been described as above, it should be understood that the embodiments disclosed herein are illustrative and non-restrictive in every respect. The scope of the present invention is defined by the terms of the claims, and is intended to include any modifications within the meaning and scope equivalent to the terms of the claims.

What is claimed is:

1. A stationary induction apparatus comprising:

an iron core;

a plurality of windings wound around the iron core as a central axis and arranged so as to be coaxial with each other; and a plurality of electrostatic shields each formed in an annular shape and each arranged adjacent to an end of a corresponding one of the plurality of windings in a direction along the central axis, each of the plurality of electrostatic shields including an insulator portion and a conductor portion that is disposed annularly around the central axis on an inside of the insulator portion, the conductor portion including a flat portion formed in an annular shape and extending in a circumferential direction of the central axis, and a pair of protruding portions protruding to an opposite side to each of the windings in the direction along the central axis, the pair of protruding portions each being arranged adjacent to a corresponding one of an outer circumferential end and an inner circumferential end of the flat portion, the insulator portion being provided with a first housing portion housing the flat portion and a pair of second housing portions each housing a corresponding one of the pair of protruding portions, each of the pair of second housing portions having an inner surface located on the opposite side to each of the windings in the direction along the central axis, the inner surface being formed in a semicircular shape in a cross-sectional view, each of the pair of protruding portions including a protruding end portion located along the inner surface of a corresponding one of the pair of second housing portions, and a center portion located adjacent to the protruding end portion on a side of each of the windings in the direction along the central axis, and in each of the pair of protruding portions, the protruding end portion and the center portion being electrically connected to each other and being equal in electric potential to each other.

2. The stationary induction apparatus according to claim 1, wherein in each of the pair of protruding portions, the center portion is sandwiched between the protruding end portion and the insulator portion.

3. The stationary induction apparatus according to claim 1, wherein the inner surface of each of the pair of second housing portions that is located on the opposite side to each of the windings in the direction along the central axis is covered by the protruding end portion such that three-quarters or more of a semicircle of the inner surface is covered in a cross-sectional view.

4. The stationary induction apparatus according to claim 1, wherein each of the pair of second housing portions is filled with a corresponding one of the pair of protruding portions.

5. The stationary induction apparatus according to claim 4, wherein each of the pair of protruding portions protrudes also to each of the windings in the direction along the central axis, and the inner surface of each of the pair of second housing portions is formed in a circular shape in a cross-sectional view.

6. The stationary induction apparatus according to claim 1, wherein the insulator portion is formed of a first insulator portion located on a side of each of the windings in the direction along the central axis; and a second insulator portion located on a side opposite to each of the windings in the direction along the central axis, the second insulator portion is provided with an annular groove portion serving as the first housing portion and the pair of second housing portions, and a material forming the second insulator portion is less in relative permittivity than a material forming the first insulator portion.

* * * * *